US012409917B1

(12) United States Patent
Xiang et al.

(10) Patent No.: US 12,409,917 B1
(45) Date of Patent: Sep. 9, 2025

(54) METHOD AND DEVICE FOR DOCKING CONTROL OF UNDERWATER VEHICLES BASED ON IMAGING SONAR

(71) Applicant: HUAZHONG UNIVERSITY OF SCIENCE AND TECHNOLOGY, Hubei (CN)

(72) Inventors: Xianbo Xiang, Hubei (CN); Zhao Wang, Hubei (CN); Shaolong Yang, Hubei (CN); Gong Xiang, Hubei (CN); Yan Wang, Hubei (CN)

(73) Assignee: HUAZHONG UNIVERSITY OF SCIENCE AND TECHNOLOGY, Hubei (CN)

( * ) Notice: Subject to any disclaimer, the term of this patent is extended or adjusted under 35 U.S.C. 154(b) by 0 days.

(21) Appl. No.: 19/075,799

(22) Filed: Mar. 11, 2025

(30) Foreign Application Priority Data

Mar. 11, 2024 (CN) ..... 202410272445.9

(51) Int. Cl.

| | |
|---|---|
| ***B63G 8/14*** | (2006.01) |
| ***B63B 79/10*** | (2020.01) |
| ***B63B 79/20*** | (2020.01) |
| ***B63B 79/40*** | (2020.01) |
| ***B63G 8/39*** | (2006.01) |

(52) U.S. Cl.
CPC ..... *B63B 79/20* (2020.01); *B63B 79/10* (2020.01); *B63B 79/40* (2020.01); *B63G 8/14* (2013.01); *B63G 8/39* (2013.01)

(58) Field of Classification Search
CPC ..... B63B 79/20; B63B 79/40; B63B 79/10; B63G 8/14; B63G 8/39
See application file for complete search history.

(56) References Cited

U.S. PATENT DOCUMENTS 12,313,027 B2 * 5/2025 Weaver ..... H02K 7/1823
12,313,806 B2 * 5/2025 Soloviev ..... G01V 3/081
(Continued)

FOREIGN PATENT DOCUMENTS

CN 114721409 7/2022

OTHER PUBLICATIONS

Karimanzira et al., Fuzzy logic docking control for underwater vehicles based on deep learning feature selection, 2021, IEEE, p., (Year: 2021).*

(Continued)

*Primary Examiner* — Mcdieunel Marc
(74) *Attorney, Agent, or Firm* — JCIPRNET

(57) ABSTRACT

A method and device for docking control of an underwater vehicle based on sonar imaging, belonging to the field of vehicle automatic control technology. Decomposes docking control of the underwater vehicle into depth tracking control and horizontal plane docking control, designs corresponding reinforcement learning cost functions to train deep network-based depth tracking controller and servo docking controller, designs nonlinear weight to balance position error and field of view in the cost function, and uses reinforcement learning to make the controller learn optimized control strategy, quickly eliminate position error and maintain recovery device features in the imaging sonar field of view. The device may effectively avoid docking failure caused by loss of target features and improve docking success rate.

7 Claims, 10 Drawing Sheets

(56) References Cited

U.S. PATENT DOCUMENTS

| | | | | |
|---|---|---|---|---|
| 2025/0085399 | A1* | 3/2025 | Das | G01S 7/4814 |
| 2025/0117017 | A1* | 4/2025 | De Ornelas Flor | G05D 1/246 |
| 2025/0148098 | A1* | 5/2025 | DeBellis | G06F 21/604 |
| 2025/0157265 | A1* | 5/2025 | Tonhajzer | B64D 45/00 |

OTHER PUBLICATIONS

Eskandarian, Scanning the Issue, 2023, IEEE, p. 13524-13547 (Year: 2023).*

Patil et al., Deep Reinforcement Learning for Continuous Docking Control of Autonomous Underwater Vehicles: A Benchmarking Study, 2021, IEEE, p. 1-7 (Year: 2021).*

Pinto et al., An autonomous surface-aerial marsupial robotic team for riverine environmental monitoring: Benefiting from coordinated aerial, underwater, and surface level perception, 2014, IEEE, p. 443-450 (Year: 2014).*

* cited by examiner

METHOD AND DEVICE FOR DOCKING CONTROL OF UNDERWATER VEHICLES BASED ON IMAGING SONAR

CROSS-REFERENCE TO RELATED APPLICATION

This application claims the priority benefit of China application serial no. 202410272445.9, filed on Mar. 11, 2024. The entirety of the above-mentioned patent application is hereby incorporated by reference herein and made a part of this specification.

BACKGROUND

Technical Field

The present disclosure belongs to the field of automatic control technology for vehicles, and more specifically, relates to a method and device for docking control of underwater vehicles based on imaging sonar.

Description of Related Art

Currently, autonomous underwater vehicles are widely employed in various underwater operations, including resource exploration, seabed mapping, and marine structure maintenance. Underactuated underwater vehicles have gained prominence in high-velocity, long-range missions such as underwater inspection and search operations due to their favorable hydrodynamic characteristics and simplified configuration. Given the limited onboard energy of underwater vehicles, when encountering long-range missions, underwater vehicles need to autonomously dock to replenish energy and exchange data, thereby indirectly enhancing their operational endurance. Consequently, autonomous docking is a critical technology for improving the operational efficiency of underwater vehicles, with autonomous docking control being an essential component in ensuring successful docking rates and operational safety. However, constrained by the limited perception range of sensors, such as underwater cameras and imaging sonars, autonomous docking control for underwater vehicles not only has to eliminate position and attitude errors but also considers the constraints of limited perception range. This is necessary to avoid losing sight of the recovery device features during the docking process, which could lead to docking failures and safety hazards. This consideration is particularly crucial for underactuated underwater vehicles, which need to also account for kinematic constraints. Therefore, the key issue in improving docking success rates and vehicle safety is whether the docking control of underwater vehicles can achieve high-precision docking while maintaining feature capture of the target recovery device within the constraints of limited perception range.

The current docking technology for underactuated underwater vehicles faces difficulties in effectively combining the perceptual constraints of the recovery device with the docking motion constraints. Consequently, during the docking process, there is a propensity for the loss of target docking features, ultimately resulting in docking failure.

SUMMARY

In view of the above deficiencies or improvement needs in the existing technology, the present disclosure provides a method, device, equipment, and storage medium for docking control of underwater vehicles. The purpose of the present disclosure lies in solving the problem of easily losing target features during the docking process of an underactuated underwater vehicle.

To achieve the above-mentioned purpose, in a first aspect, the present disclosure provides a method for servo docking control of an underwater vehicle, including:

The depth error between the vehicle and the recovery device, the pitch angle, velocity, and angular velocity of the vehicle may be used as the input state vector of the depth tracking controller. A reinforcement learning cost function is designed to train a deep network-based depth tracking controller, thereby implementing depth tracking control of the vehicle;

The relative position of the recovery device, the difference between the heading angles of the recovery device and the vehicle, the velocity, the angular velocity, and the rudder angle of the steering rudder of the vehicle are used as the input state vector of the servo docking controller. According to the relative position and the difference in heading angles, three docking states may be classified. For different docking states, reinforcement learning cost functions are designed respectively to train the deep network-based servo docking controller, thereby implementing horizontal plane docking control of the vehicle.

Preferably, the input state vector of the depth tracking controller specifically is as follows:

$$\{e_z,\theta,u,v,w,p,q,r\}$$

Specifically, $e_z$ represents the depth error between the vehicle and the recovery device, θ denotes the pitch angle of the vehicle, u signifies the forward linear velocity of the vehicle, v indicates the lateral linear velocity of the vehicle, w represents the vertical linear velocity of the vehicle, p denotes the roll angular velocity of the vehicle, q signifies the pitch angular velocity of the vehicle, and r represents the heading yaw angular velocity of the vehicle.

Preferably, the reinforcement learning cost function of the depth tracking controller is as follows:

$$rws=-k_z|e_z|-k_\theta|\theta|-k_p|p|$$

Specifically, rws represents the total cost value of deep reinforcement learning; $k_z$ denotes the depth error weight; $k_\theta$ signifies the pitch angle weight; and p designates the roll angular velocity weight.

Preferably, the input state vector of the servo docking controller is specifically as follows:

$$\{x,y,e_\psi,u,v,w,p,q,\Delta r,\delta_r\}$$

Specifically, x and y respectively represent the forward coordinate and lateral coordinate of the recovery device relative to the vehicle, $e_\psi$ denotes the difference between the heading angle of the recovery device and that of the vehicle, u signifies the forward linear velocity of the vehicle, v indicates the lateral linear velocity of the vehicle, w denotes the vertical linear velocity of the vehicle, p represents the roll angular velocity of the vehicle, q signifies the pitch angular velocity of the vehicle, Δr denotes the difference in heading yaw angular velocity of the vehicle within the control time interval, and $\delta_r$ represents the rudder angle of the steering rudder of the vehicle.

Preferably, three docking states are classified according to the relative position and the difference in heading angles, specifically:

If the following condition is met: $e_\psi<0$, $\vartheta>0$, $|e_\psi|<|\vartheta|$, then the docking state is adjusting the heading angle to the right;

If the following condition is met: $e_\psi>0$, $\vartheta<0$, $|e_\psi|<|\vartheta|$, then the docking state is adjusting the heading angle to the left;

Otherwise, the docking state is error adjustment;

Specifically, 9 represents the positional angle, $$\vartheta = \arctan\frac{y}{x}.$$

Preferably, the reinforcement learning cost function for the servo docking controller is as follows:

The reinforcement learning cost function in the state of adjusting the heading angle to the right is as follows:

$$rws=-k_\chi p_\chi(\chi)-k_\vartheta p_\vartheta(\vartheta)-k_r|\Delta r|-k_{\delta_r}|\delta_r-\delta_r^{max}|$$

Herein, rws represents the total cost value of reinforcement learning for docking, $k_\chi$ denotes the docking path deviation weight, while $k_\vartheta$ signifies the bearing angle deviation weight, $p_\chi(\chi)$ is the tuning function for the docking path deviation, $p_\vartheta(\vartheta)$ is the tuning function for the bearing angle deviation, $k_r$ denotes the difference weight in heading angle, $k_{\delta_r}$ represents the rudder angle weight, and $\delta_r^{max}$ indicates the maximum amplitude of the steering rudder angle for the vehicle.

The reinforcement learning cost function in the state of adjusting the heading angle to the left is as follows:

$$rws=-k_\chi p_\chi(\chi)-k_\vartheta p_\vartheta(\vartheta)-k_r|\Delta r|-k_{\delta_r}|\delta_r-\delta_r^{max}|$$

The reinforcement learning cost function in the error adjustment state is as follows:

$$rws=-k_\chi p_\chi(\chi)-k_\vartheta p_\vartheta(\vartheta)-k_r|\Delta r|$$

The preferred tuning function $p_\chi(\chi)$ for the docking path deviation is as follows:

$$p_\chi(\chi) = \frac{e^{\frac{|\chi|}{\chi_{max}-e}-\frac{|\chi|}{\chi_{max}}}}{2}\chi_{max}$$

Herein, $\chi$ represents the docking path deviation, $\chi=R\sin(e_\psi+9)$, $R=\sqrt{x^2+y^2}$, $\chi_{max}$ denotes half of the sonar field of view width, and e is the natural constant;

The tuning function $p_\vartheta(\vartheta)$ for the bearing angle deviation is as follows:

$$p_\vartheta(\vartheta)=e^{\varepsilon|\vartheta|}$$

Herein, $\varepsilon$ represents the constant exponential coefficient.

In a second aspect, the present disclosure provides a docking control device for an underwater vehicle, including:

A depth tracking unit, for using the depth error between the vehicle and the recovery device, the pitch angle, velocity, and angular velocity of the vehicle as the input state vector of the depth tracking controller, designing a reinforcement learning cost function to train a deep network-based depth tracking controller, thereby implementing depth tracking control of the vehicle;

A horizontal docking unit, for using the relative position of the recovery device, the difference between the heading angles of the recovery device and the vehicle, the velocity, the angular velocity, and the rudder angle of the steering rudder of the vehicle as the input state vector of the servo docking controller, classifying three docking states according to the relative position and the difference in heading angles, and designing reinforcement learning cost functions respectively to train the deep network-based servo docking controller for different docking states, thereby implementing horizontal plane docking control of the vehicle.

In a third aspect, the present disclosure provides an electronic device, including: a memory, for storing programs; a processor, for executing the programs stored in the memory, when the programs stored in the memory are executed, the processor is used to perform the method described in the first aspect or any possible implementation of the first aspect.

In a fourth aspect, the present disclosure provides a computer-readable storage medium. The computer-readable storage medium stores a computer program. When the computer program is run on a processor, the processor is enabled to execute the method described in the first aspect or any possible implementation of the first aspect.

Overall, compared with the existing technology, the technical solutions conceived by the present disclosure have the following advantageous effects:

(1) The present disclosure achieves servo docking control by training a deep network based on reinforcement learning, decomposing the underwater vehicle docking control into depth tracking control and horizontal plane docking control, designing corresponding reinforcement learning cost functions to train the controller, balancing position error and field of view in the cost function through nonlinear weighting, and using reinforcement learning to enable the controller to learn optimized control strategies. In this way, it is possible to rapidly eliminate position errors while maintaining recovery device features in the imaging sonar field of view, improving docking success rate and avoiding control oscillations caused by target loss.

(2) The technical solution of the present disclosure may be deployed on the onboard industrial control computer of the underwater vehicle, reading the state data fed back by sensors and the output from the rear end of the forward-looking imaging sonar, controlling the execution mechanisms of the elevator and rudder, forming a sonar-visual servo docking control system, thus realizing autonomous docking.

DESCRIPTION OF THE EMBODIMENTS

In order to make the purpose, technical solution, and advantages of the present disclosure more comprehensible, the following description provides further details of the application in conjunction with the accompanying drawings and embodiments. It should be understood that the specific embodiments described herein are used only to explain the present disclosure and are not intended to limit the present disclosure.

Figure 1:
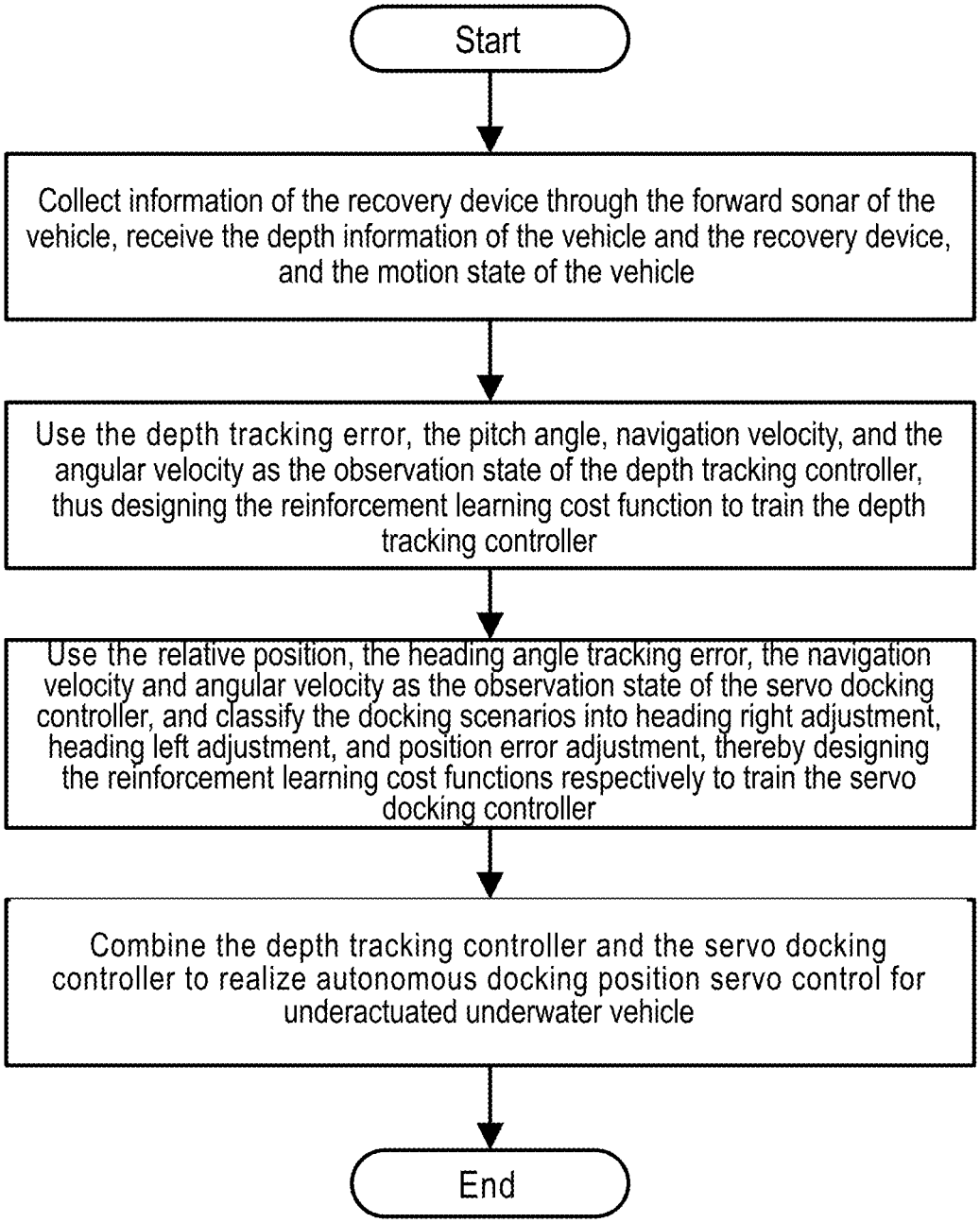
FIG. 1 is a flowchart of a servo docking control method for an underwater vehicle provided by an embodiment of the present disclosure.

FIG. 1 is a flowchart of a method for docking control of an underwater vehicle based on sonar imaging provided by an embodiment of the present disclosure. As shown in FIG. 1, the method specifically includes the following steps:

(1) Through the forward-looking imaging sonar mounted on the bow of the underactuated underwater vehicle to collect information of the recovery device, the sonar image is processed by the back-end to determine the relative position between the underwater vehicle and the recovery device, as well as the attitude information of the recovery device. The information includes: forward distance, lateral distance, and the heading angle of the recovery device.

The underwater vehicle obtains its own state information and receives the state information of the recovery device. The state information includes: depth of the recovery device, depth of the vehicle, velocity of the vehicle, attitude angle of the vehicle, and angular velocity of the vehicle.

(2) The depth tracking error is determined based on the depth of the recovery device and the current depth, and the depth tracking error, pitch angle, navigation velocity, and angular velocity are used as the observation state of the depth tracking controller, and a reinforcement learning cost function is designed to train the deep network controller to implement target depth tracking of the underactuated underwater vehicle.

(3) The heading tracking error is determined according to the heading angle of the recovery device and the current heading angle of the underwater vehicle, and the relative position, heading tracking error, navigation velocity and angular velocity are used as the observation state of the horizontal plane controller, and the docking scenario is classified into three conditions: heading right adjustment, heading left adjustment, and position error adjustment, and reinforcement learning cost functions are designed respectively to train the deep network controller to implement horizontal plane servo control for underactuated underwater vehicle based on imaging sonar localization.

(4) The depth tracking controller and servo docking controller that are trained based on the designed reinforcement learning cost function are combined, making the underwater vehicle to navigate stably at the desired depth and maintain the vertical position consistency between the forward-looking imaging sonar and the center of the recovery device; autonomous docking position servo control is realized for the underactuated underwater vehicle, and feature capture of the recovery device in the field of view of the forward-looking sonar is maintained under kinematic constraints and limited field of view constraints, so that the docking success rate is improved and it is possible to avoid potential control oscillations and safety risks caused by the loss of target recovery device features.

Figure 2:
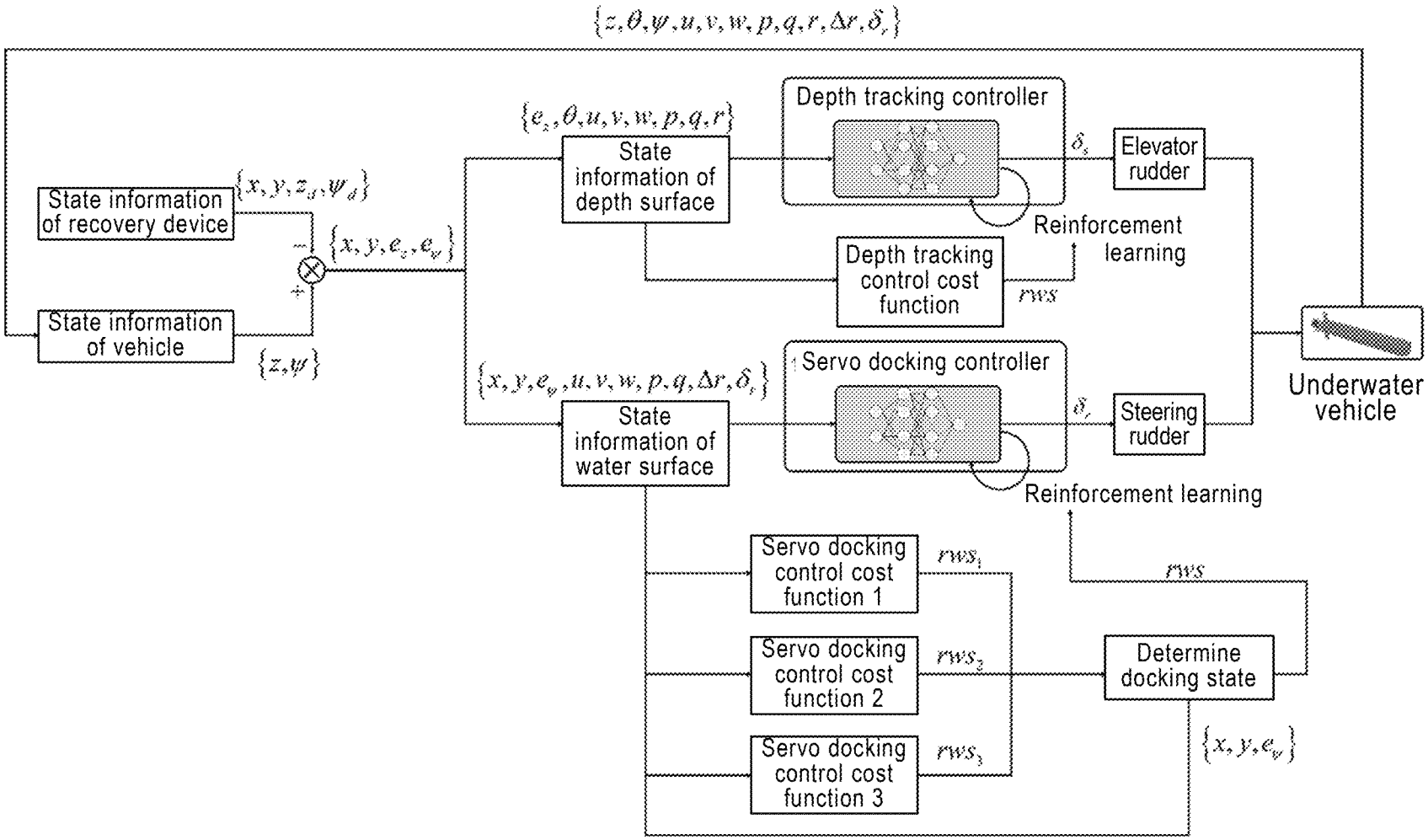
FIG. 2 is a schematic diagram of the docking control algorithm provided by an embodiment of the present disclosure.

FIG. 2 is a schematic diagram of the docking control algorithm provided by an embodiment of the present disclosure; as shown in FIG. 1, specifically:

The underwater vehicle collects information on the recovery device through a forward-looking imaging sonar mounted on the bow, while simultaneously collecting the motion state of the vehicle itself and depth information of both the vehicle and the recovery device.

The deep network-based depth tracking controller and the servo docking controller are trained using the above information.

For the depth tracking controller, the depth tracking error $e_z$ is obtained by subtracting the current depth z of the underwater vehicle from the depth $z_d$ of the recovery device. This results in the input state vector for the depth tracking controller:

$$\{e_z, \theta, u, v, w, p, q, r\}$$

In the formula, θ denotes the pitch angle of the underwater vehicle, u signifies the forward linear velocity of the underwater vehicle, v indicates the lateral linear velocity of the underwater vehicle, w represents the vertical linear velocity of the underwater vehicle, p denotes the roll angular velocity of the underwater vehicle, q signifies the pitch angular velocity of the underwater vehicle, and r represents the heading yaw angular velocity of the underwater vehicle.

The reward value is calculated according to the reinforcement learning cost function of the depth tracking controller:

$$rws = -k_z|e_z| - k_\theta|\theta| - k_p|p|$$

Specifically, rws represents the total cost value of deep reinforcement learning; $k_z$ denotes the depth tracking error weight; $k_\theta$ signifies the pitch angle weight; and p designates the roll angular velocity weight.

The deep network-based depth tracking controller is iteratively trained according to the calculated reward value during the reinforcement learning process until the depth tracking converges.

With respect to the servo docking controller, the heading tracking error $e_\psi$ is obtained by subtracting the current heading angle ψ of the underwater vehicle from the heading angle da of the recovery device. This results in the input state vector for the servo docking controller:

$$\{x, y, e_\psi, u, v, w, p, q, \Delta r, \delta_r\}$$

Specifically, x and y respectively represent the forward coordinate and lateral coordinate of the recovery device feature relative to the field of view origin in the forward-looking imaging sonar field of view; u signifies the forward linear velocity of the underwater vehicle, v indicates the lateral linear velocity of the underwater vehicle, w denotes the vertical linear velocity of the underwater vehicle, p represents the roll angular velocity of the underwater vehicle, q signifies the pitch angular velocity of the underwater vehicle, Δr denotes the difference in heading yaw angular velocity of the underwater vehicle within the continuous control time interval, and $\delta_r$ represents the rudder angle of the steering rudder of the underwater vehicle.

The positional angle $\vartheta$ and relative distance R are calculated respectively:

$$\vartheta = \arctan\frac{y}{x}$$

$$R = \sqrt{x^2 + y^2}$$

The docking path deviation $\chi$ of the underwater vehicle is calculated as follows:

$$\chi = R\sin(e_\psi + \vartheta)$$

The position deviation harmonizing weight $p_\chi(\chi)$ is calculated as follows:

$$p_\chi(\chi) = \frac{e^{\frac{|\chi|}{\chi^{max}-e}} - \frac{|\chi|}{\chi^{max}}}{2}\chi_{max}$$

In the formula, $\chi_{max}$ represents one-half of the field of view width of the forward-looking imaging sonar; e denotes the natural constant.

The bearing angle deviation harmonizing weight $p_\vartheta(\vartheta)$ is calculated as follows:

$$p_\vartheta(\vartheta) = e^{\varepsilon|\vartheta|}$$

Herein, $\varepsilon$ represents the constant exponential coefficient.

The docking state is determined based on the relative position between the recovery device and the underwater vehicle. When the following condition is met: $e_\psi<0$, $\vartheta>0$, $|e_\psi|<|\vartheta|$, it is determined that the docking state is adjusting the heading angle to the right. The reward value is calculated according to the reinforcement learning cost function of the servo docking controller in the rightward adjustment state:

$$rws = -k_\chi p_\chi(\chi) - k_\vartheta p_\vartheta(\vartheta) - k_r|\Delta r| - k_{\delta_r}|\delta_r - \delta_r^{max}|$$

Herein, rws represents the total cost value of reinforcement learning, $k_{\delta_r}$ represents the current rudder angle weight, $\delta_r^{max}$ indicates the amplitude of the steering rudder angle for the underwater vehicle; $k_\chi$ denotes the docking path deviation weight, $k_\vartheta$ signifies the bearing angle deviation weight; and $k_r$ denotes the difference weight in heading angle.

When the following condition is met: $e_\psi>0$, $\vartheta<0$, $|e_\psi|<|\vartheta|$, it is determined the docking state is adjusting the heading angle to the left. The reward value is calculated according to the reinforcement learning cost function of the servo docking controller in the leftward adjustment state:

$$rws = -k_\chi p_\chi(\chi) - k_\vartheta p_\vartheta(\vartheta) - k_r|\Delta r| - k_{\delta_r}|\delta_r - \delta_r^{max}|$$

When the state conditions satisfy neither the bow-right adjustment nor the bow-left adjustment, the docking state is determined to be position error adjustment; the reward value is calculated according to the reinforcement learning cost function of the servo docking controller under the position error state:

$$rws = -k_\chi p_\chi(\chi) - k_\vartheta p_\vartheta(\vartheta) - k_r|\Delta r|$$

The deep network of the servo docking controller is iteratively trained in the reinforcement learning process according to calculated reward values until the position error and heading error converge.

The deep network-based depth tracking controller and servo docking controller are trained through the above method and deployed in the underwater vehicle.

When the underwater vehicle executes the docking and recovery task, it may collect information of the recovery device, the motion state of the vehicle itself, and the depth information of the vehicle and the recovery device in real time; and input the above data to the depth tracking controller and servo docking controller after processing. The depth tracking controller and servo docking controller output elevator commands and rudder commands to control the servo actuators, so that the underwater vehicle navigates stably according to the desired depth and maintain vertical position consistency between the forward-looking imaging sonar and the center of the recovery device. The feature capture of the recovery device is maintained under the constraint of the limited field of view of the imaging sonar, thereby improving the docking success rate and avoiding potential control oscillations and safety risks caused by the loss of target recovery device features.

Figure 3A:
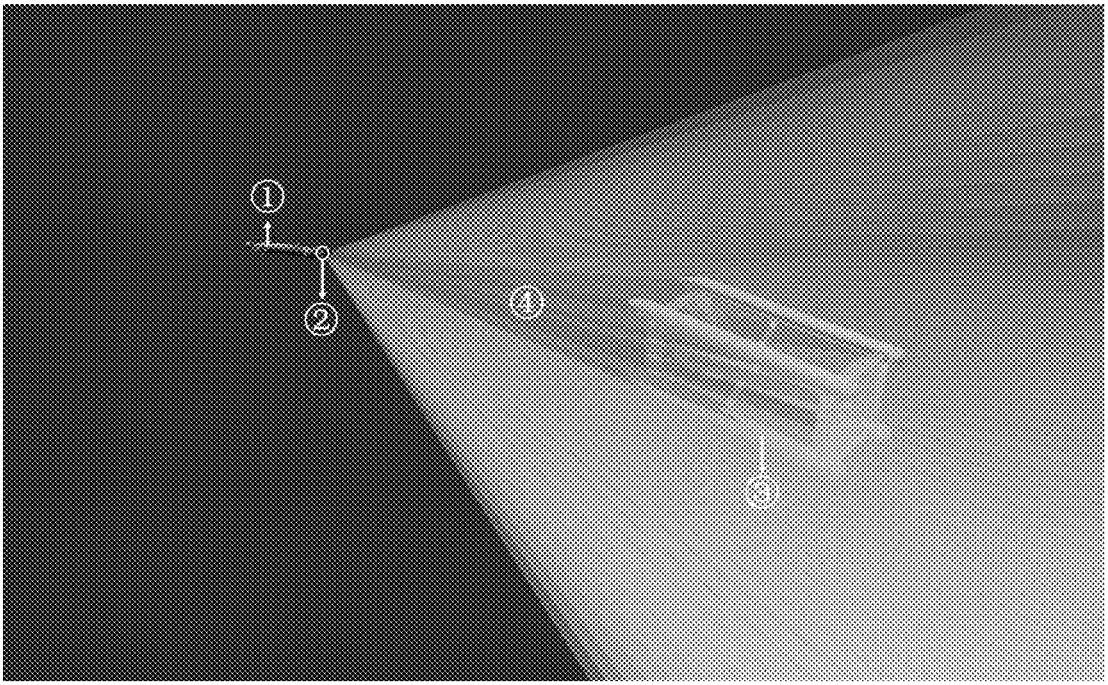
FIG. 3A is a schematic diagram of the environment for a docking simulation experiment of an underwater vehicle provided by an embodiment of the present disclosure.
Figure 3B:
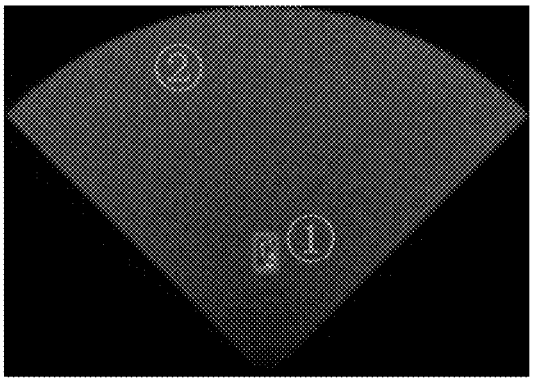
FIG. 3B is a schematic diagram of a fan-shaped field of view area for simulated imaging sonar provided by an embodiment of the present disclosure.

To verify the reliability and practicality of the method of the present disclosure, a typical underwater vehicle acoustic-visual guided docking simulation environment as shown in FIG. 3A is used as a test platform. The underwater vehicle as shown in ① in this simulation environment has underactuated characteristics, and a forward-looking imaging sonar simulation plugin as shown in ② is configured at the bow of the model. As shown in ③ is a typical recovery device of an underactuated underwater vehicle, and as shown in ④ is the field of view of the forward-looking sonar. The simulation platform runs the forward-looking imaging sonar backend processing program, processes the sonar image as shown in FIG. 3B, extracts the recovery device features as shown in ①, and converts them into actual relative position and heading angle. ② shows the fan-shaped field of view area of the simulated imaging sonar on the horizontal projection plane, with a maximum distance of 40 m, a horizontal field of view is 80°, and a vertical field of view is 12°. The depth tracking controller and servo docking controller are deployed on the underwater vehicle. The controller hardware obtains the state information of the underwater vehicle and the state information of the recovery device from the simulation platform, and trains the deep network of the depth tracking controller and servo docking controller through reinforcement learning.

During the test process, the initial position of the underwater vehicle is randomly sampled with the north coordinate from −40 m to −10 m interval, the east coordinate from −25 m to 25 m interval, the heading angle from −45° to 45° interval, and the depth from 5 m to 15 m interval. The depth of the target recycle device is 10 m. When the recovery device is set to a stationary state, the test results are shown in FIG. 4A to FIG. 4D.

Figure 4A:
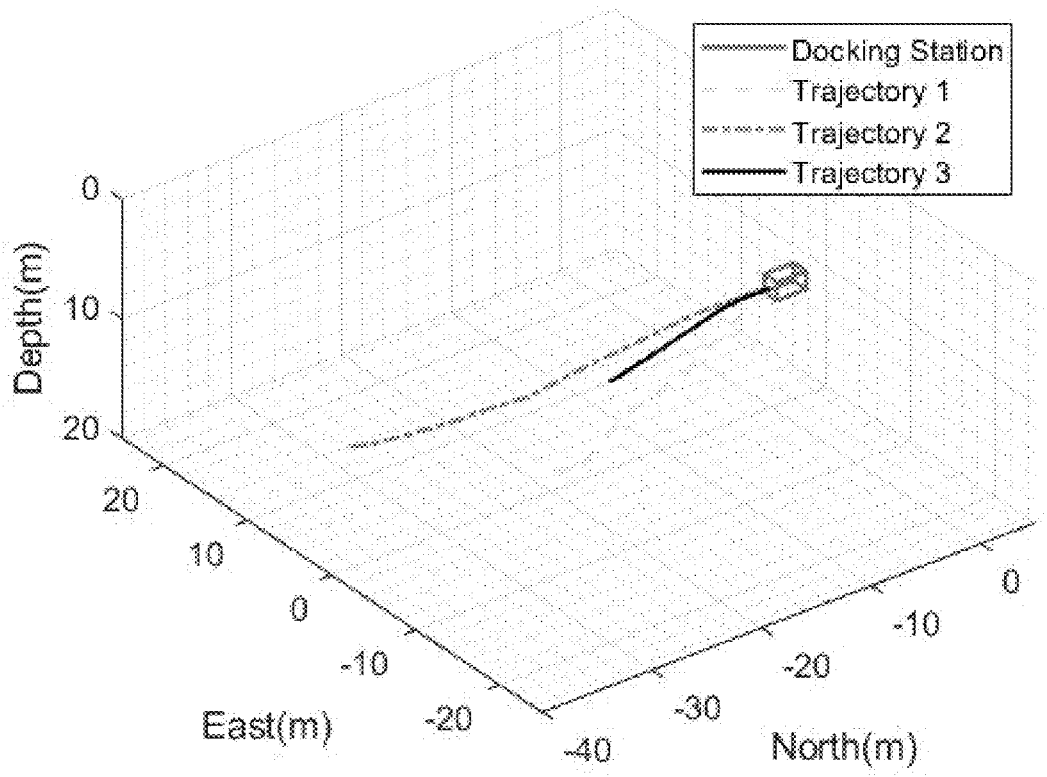
FIG. 4A is a trajectory curve diagram of a static docking simulation test provided by an embodiment of the present disclosure.
Figure 4B:
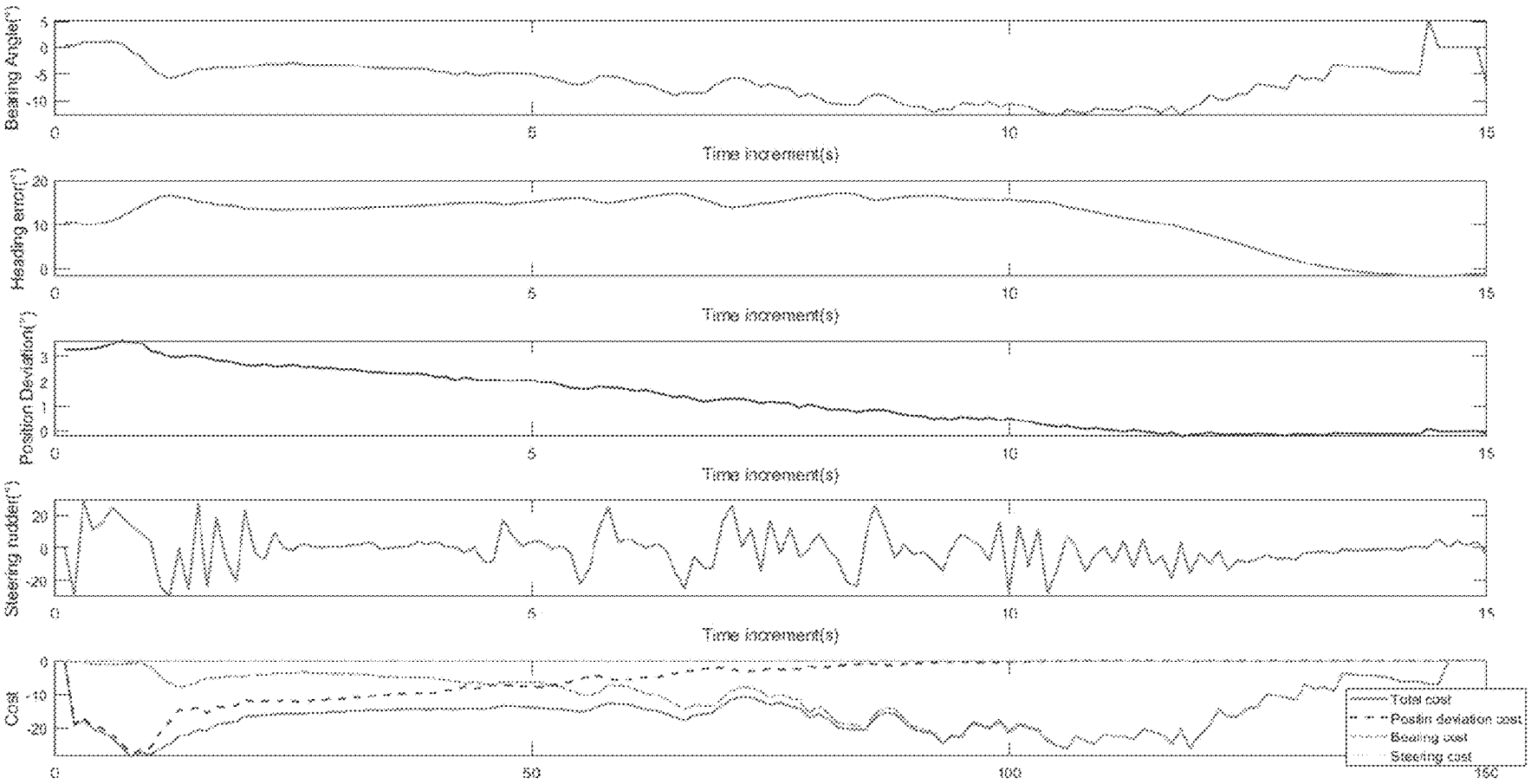
FIG. 4B is a state curve diagram of the vehicle in a static docking simulation test provided by an embodiment of the present disclosure.
Figure 4C:
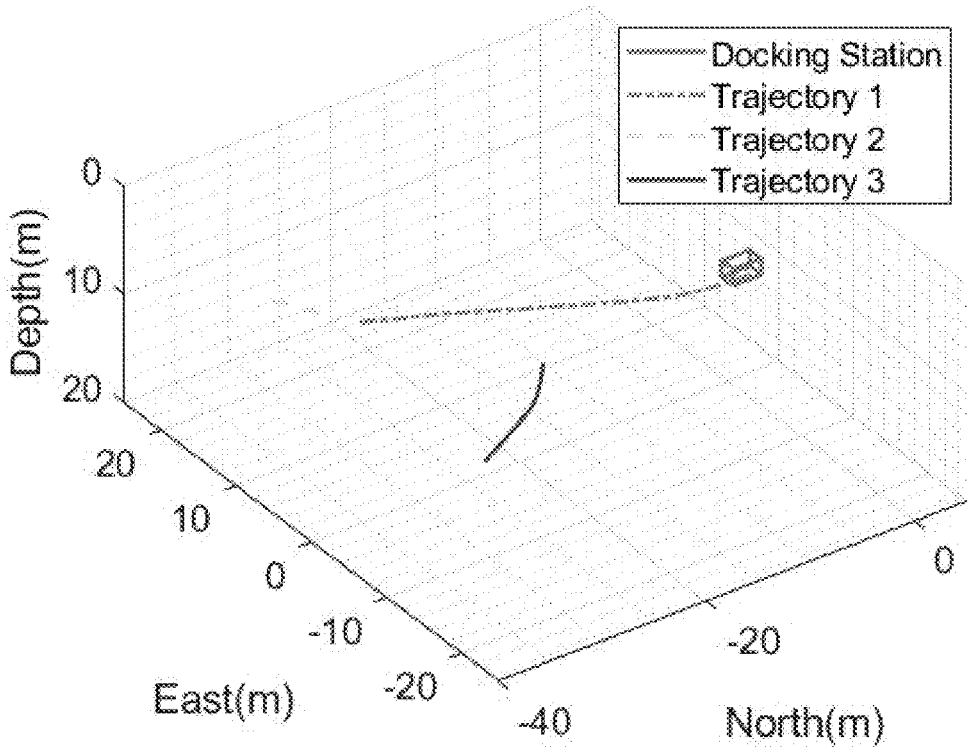
FIG. 4C is a trajectory curve diagram of a comparative simulation test provided by an embodiment of the present disclosure.
Figure 4D:
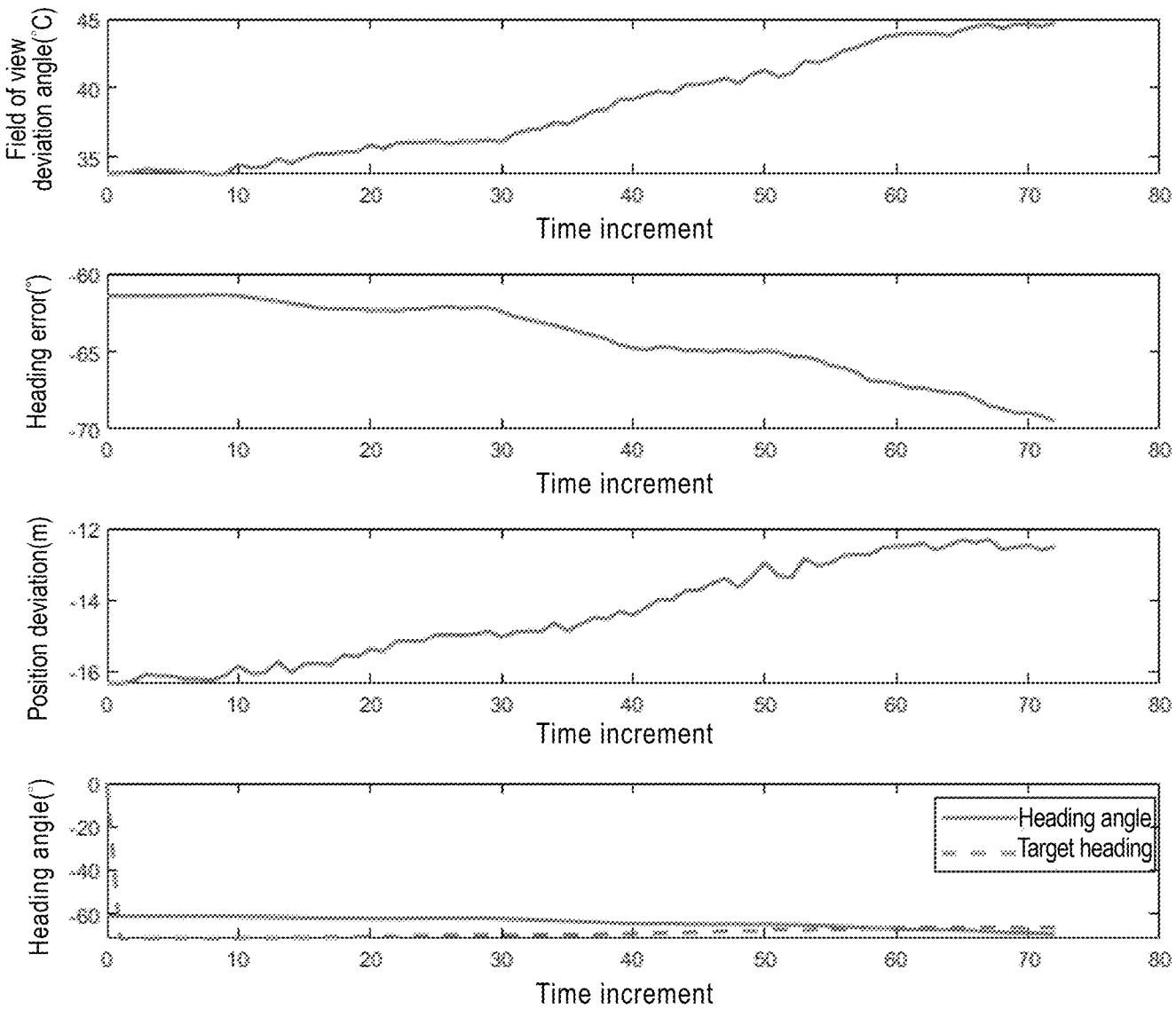
FIG. 4D is a state curve diagram of the vehicle for comparative simulation tests provided by an embodiment of the present disclosure.

FIG. 4A shows the three-dimensional space trajectories of the vehicle in some test samples. The average docking success rate of the vehicle exceeds 87%, the average depth error is not greater than 0.0003 m, and the average pitch angle of the vehicle during depth tracking is not greater than 3°, satisfying the constraint of the vertical field of view of the forward-looking imaging sonar. The high-precision depth tracking is ensured by the designed reinforcement learning cost function. FIG. 4B shows the curves of state parameters related to servo docking control of the vehicle. The average horizontal position deviation is not greater than 0.3 m, the average heading error is not greater than 3°, and the field of view deviation angle is not greater than 40° throughout the process, indicating that there is no loss of target features during the test process. FIG. 4C shows the three-dimensional space trajectories of the vehicle in some comparison samples. The comparison test samples use the classic path-following control method based on guidance for underwater vehicle to carry out docking tasks. It may be seen that among the three test samples provided, two of the vehicles fail to complete docking. Combined with the curves of position deviation, field of view deviation angle, and heading angle shown in FIG. 4D, it may be seen that when the position deviation is large, the classic path-following algorithm gives an expected heading angle that causes the vehicle to make a large turn, causing the field of view deviation angle of the recovery device feature to exceed 40°, leading to feature loss and ultimately docking failure. Therefore, the stability of target feature capture and high-precision docking performance are ensured by the reinforcement learning cost function designed for different scenario states.

Figure 5A:
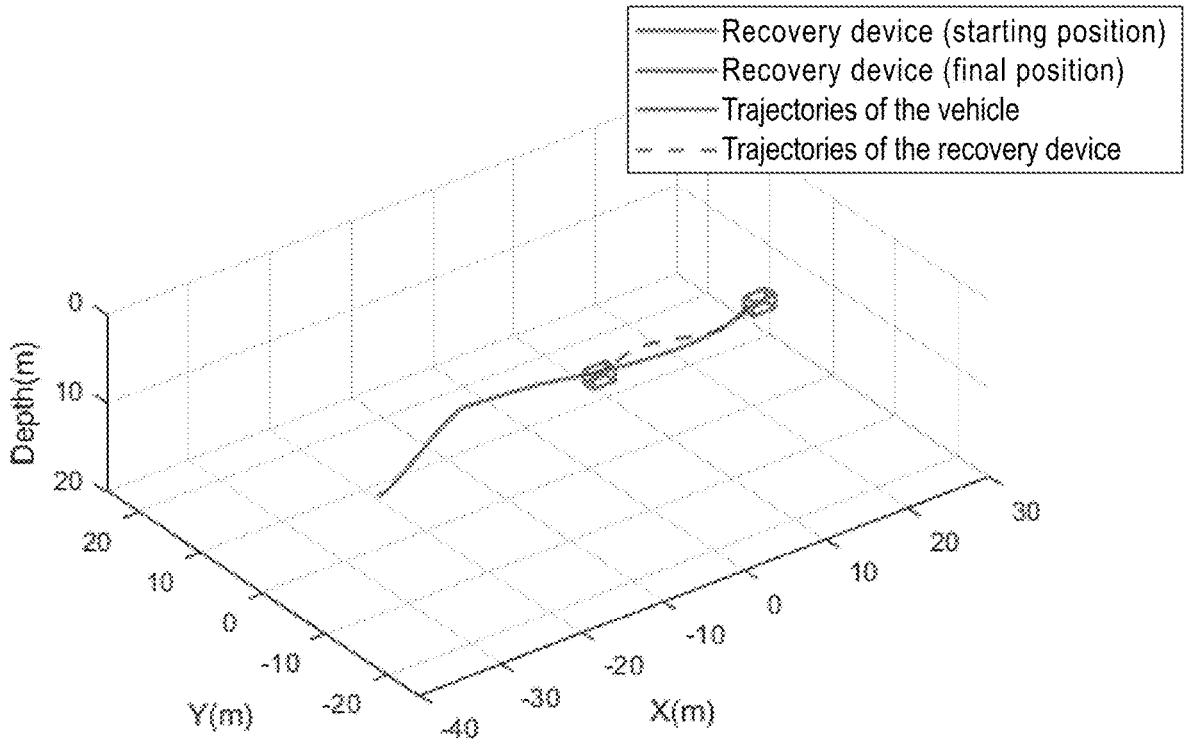
FIG. 5A is a trajectory curve diagram of dynamic docking simulation test provided by an embodiment of the present disclosure.
Figure 5B:
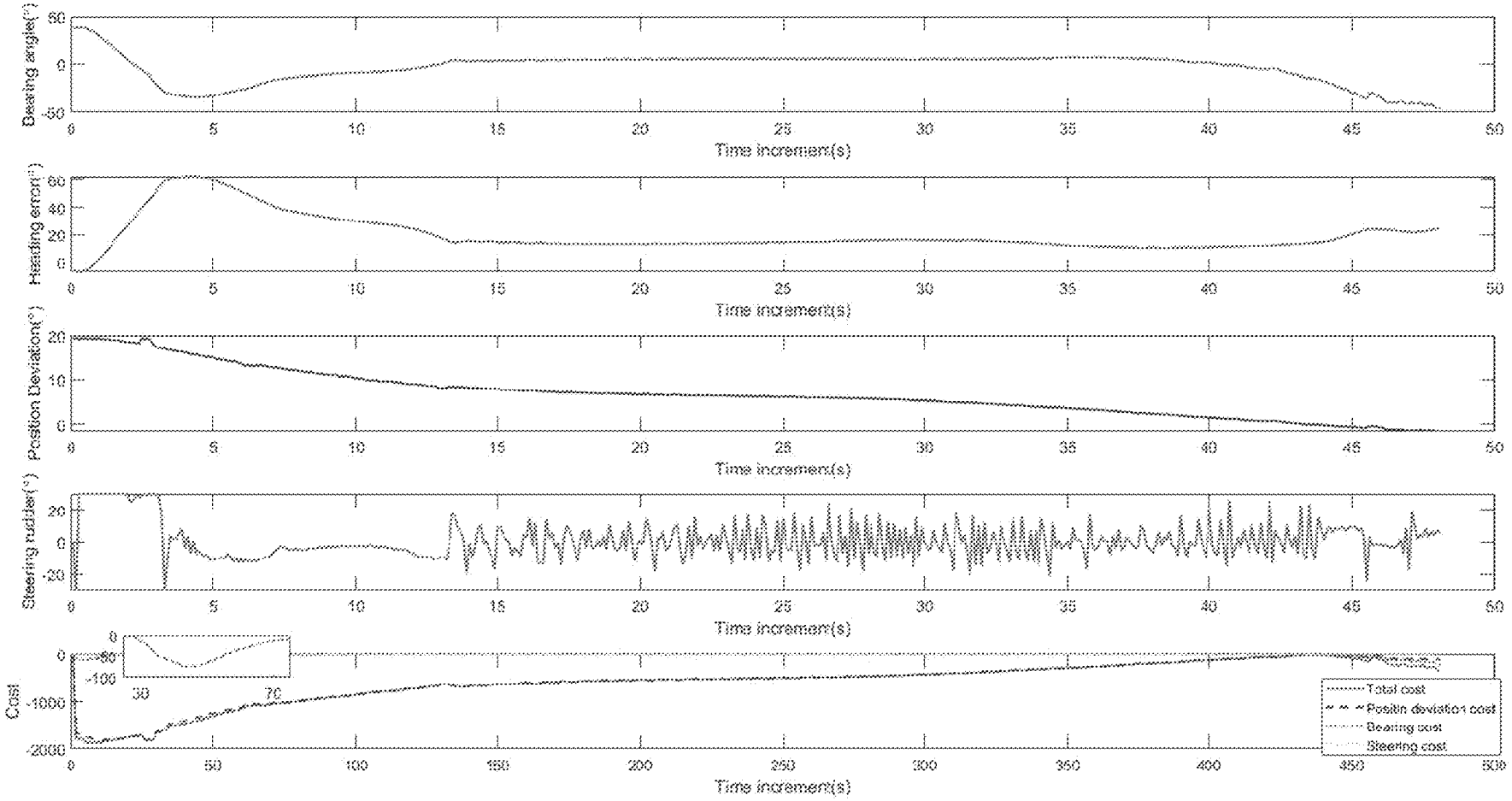
FIG. 5B is a state curve diagram of the vehicle in a dynamic docking simulation test provided by an embodiment of the present disclosure.

FIG. 5A shows the three-dimensional space trajectory of the vehicle and the recovery device when setting the recovery device to a motion state. The average docking success rate of the vehicle exceeds 80%, the average depth error is not greater than 0.001 m, and the average pitch angle of the vehicle during depth tracking process is not greater than 5°, satisfying the constraint of the forward-looking imaging sonar in the vertical field of view. The high-precision dynamic target depth tracking is ensured by the designed reinforcement learning cost function. FIG. 5B shows the state parameter curves related to the servo docking control of the vehicle. The average horizontal position deviation is not greater than 0.35 m, the average heading error is not greater than 5°, and the field of view deviation angle is not greater than 40° throughout the process, indicating that there is no loss of target features during the test process. The stability of target feature capture and high-precision docking performance in dynamic docking scenarios are ensured by the reinforcement learning cost function designed for different scenario states.

Figure 6:
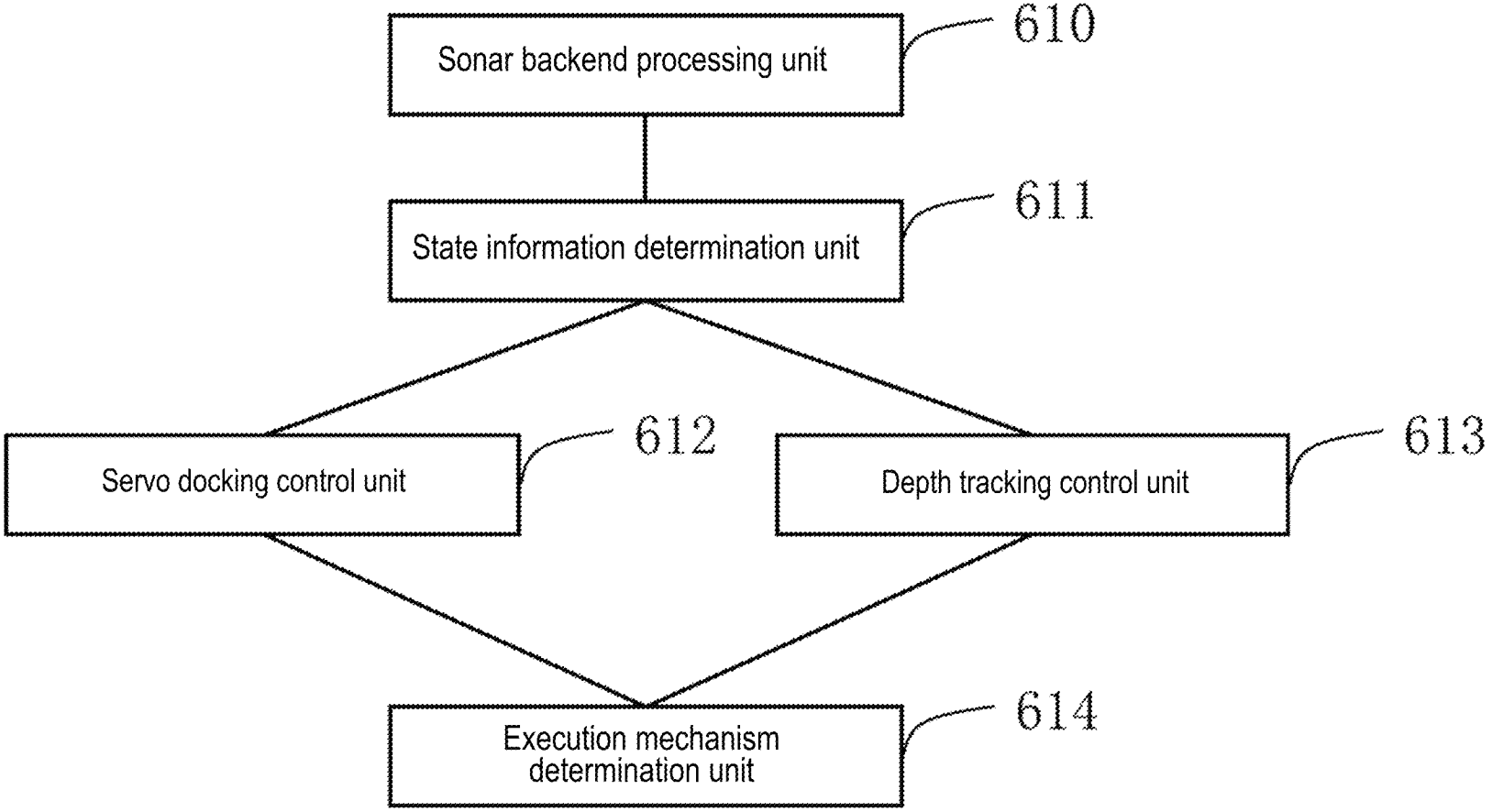
FIG. 6 is an architecture diagram of a servo docking control system provided by an embodiment of the present disclosure.

FIG. 6 is an architecture diagram of a docking control device for an underwater vehicle based on sonar imaging provided by an embodiment of the present disclosure; as shown in FIG. 6, the docking control device includes:

The sonar backend processing unit 610 is configured to extract device features of the recovery device from the imaging sonar feedback image, and determine the relative position and attitude information of the underwater vehicle with respect to the recovery device. The information includes: forward distance, lateral distance, and heading angle of the recovery device.

The state information determination unit 611 is configured to determine the state of the underwater vehicle and the depth state information of the recovery device. The state information includes: the depth of the recovery device, the current depth of the underwater vehicle, the navigation velocity, attitude angles, and angular velocity.

The servo docking control unit 612 determines the heading tracking error according to the heading angle of the recovery device and the current heading angle of the underwater vehicle, and uses the relative position, heading tracking error, navigation velocity and angular velocity as the observation state of the horizontal plane controller. The docking scenario is classified into three conditions: heading right adjustment, heading left adjustment, and position error adjustment. Based on different reinforcement learning cost functions, deep network controllers are trained to implement horizontal plane servo control of the underactuated underwater vehicle based on imaging sonar localization.

The depth tracking control unit 613 determines the depth tracking error based on the recycle device depth and current depth, and uses the depth tracking error, pitch angle, navigation velocity and angular velocity as the observation state of the depth tracking controller, training the deep network controller to implement target depth tracking for the underactuated underwater vehicle based on the reinforcement learning cost function.

The execution mechanism determination unit 614 combines the rudder angle output by the depth tracking controller and servo docking controller that are trained based on the designed reinforcement learning cost function, so that the elevator and rudder of the underactuated underwater vehicle execute according to the rudder angle, to implement the underwater vehicle navigating stably at the desired depth and maintaining the vertical position consistency between the forward-looking imaging sonar and the center of the recovery device, maintaining feature capture of the recovery device under the constraint of limited field of view of the imaging sonar, while improving the docking success rate and avoiding potential control oscillations and safety risks caused by the loss of target recovery device features.

It should be understood that the above-mentioned device is used to execute the method in the above embodiments. The corresponding program modules in the device have similar implementation principles and technical effects to those described in the above method. The working process of the device may refer to the corresponding process in the above method, which will not be repeated here.

Based on the method in the above-mentioned embodiment, an embodiment of the present disclosure provides an electronic device, which includes: a processor 810, a communications interface 820, a memory 830, and a communication bus 840, wherein the processor 810, the communications interface 820, and the memory 830 complete communication with each other through the communication bus 840. The processor 810 may invoke the logical instructions in the memory 830 to execute the method in the above-mentioned embodiment.

In addition, the logical instructions in the memory 830 mentioned above may be implemented in the form of software functional units and sold or used as independent products, which may be stored in a computer-readable storage medium. Based on this understanding, the technical solution of the present disclosure, or the part that essentially contributes to the prior art, or part of the technical solution may be embodied in the form of a software product. The computer software product is stored in a storage medium and includes several instructions to enable a computer device (which may be a personal computer, server, or network device, etc.) to execute all or part of the steps of the method described in various embodiments of the present disclosure.

Based on the method in the above-mentioned embodiment, an embodiment of the present disclosure provides a computer-readable storage medium. The computer-readable storage medium stores a computer program. When the computer program is run on a processor, the processor is enabled to execute the method in the above-mentioned embodiment.

Based on the method in the above-mentioned embodiment, an embodiment of the present disclosure provides a computer program product. When the computer program product is run on a processor, the processor is enabled to execute the method in the above-mentioned embodiment.

It may be understood that the processor in the embodiments of the present disclosure may be a central processing unit (CPU), and may also be other general-purpose processors, digital signal processors (DSP), application specific integrated circuits (ASIC), field programmable gate arrays (FPGA) or other programmable logic devices, transistor logic devices, hardware components or any combination thereof. The general-purpose processor may be a microprocessor, or may be any conventional processor.

The steps in the method in the embodiments of the present disclosure may be implemented by hardware means, or by a processor executing software instructions. The software instructions may be composed of corresponding software modules, which may be stored in random access memory (RAM), flash memory, read-only memory (ROM), programmable ROM (PROM), erasable PROM (EPROM), electrically EPROM (EEPROM), registers, hard disk, removable hard disk, CD-ROM or any other form of storage medium known in the art. An exemplary storage medium is coupled to the processor, enabling the processor to read information from and write information to the storage medium. Of course, the storage medium may also be a component of the processor. The processor and the storage medium may be located in an ASIC.

The above-mentioned embodiments may be implemented entirely or partially through software, hardware, firmware, or any combination thereof. When implemented using software, the embodiments may be implemented entirely or partially in the form of a computer program product. The computer program product includes one or more computer instructions. When the computer program instructions are loaded and executed on a computer, all or part of the process or functions described in the embodiments of the present disclosure are generated. The computer may be a general-purpose computer, a special-purpose computer, a computer network, or other programmable device. The computer instructions may be stored in a storage medium or transmitted through the storage medium. The computer instructions may be transmitted from one website, computer, server, or data center to another website, computer, server, or data center through wired (e.g., coaxial cable, optical fiber, digital subscriber line (DSL)) or wireless (e.g., infrared, wireless, microwave, etc.) means. The storage medium may be any available medium that can be accessed by a computer or a data storage device such as a server, data center, etc., that integrates one or more available media. The available medium may be a magnetic medium (e.g., floppy disk, hard disk, magnetic tape), an optical medium (e.g., DVD), or a semiconductor medium (e.g., solid state disk, SSD), etc.

It may be understood that various numerical designations involved in the embodiments of the present disclosure are merely for the convenience of description and are not intended to limit the scope of the embodiments of the present disclosure.

In the embodiments of the present disclosure, words such as "exemplary" or "for example" are used to serve as examples, illustrations or explanations. Any embodiment or design scheme described as "exemplary" or "for example" in the embodiments of the present disclosure should not be interpreted as more preferable or advantageous than other embodiments or design schemes. More precisely, the use of words such as "exemplary" or "for example" is intended to present relevant concepts in a specific manner.

In the description of the embodiments of the present disclosure, unless otherwise stated, "multiple" means two or more. For example, multiple vehicles refer to two or more vehicles, etc.

The above content is easily understood by those skilled in the art. The above description is only a preferred embodiment of the present disclosure and is not intended to limit the present disclosure. Any modifications, equivalent replacements and improvements made within the spirit and principle of the present disclosure should be included in the protection scope of the present disclosure.

What is claimed is:

1. A method for docking control of an underwater vehicle based on imaging sonar, comprising:

a depth error between a vehicle and a recovery device, a pitch angle, a velocity, and an angular velocity of the vehicle are used as an input state vector of a depth tracking controller, a reinforcement learning cost function is designed to train a deep network-based depth tracking controller, thereby implementing depth tracking control of the vehicle;

a relative position of the recovery device, a difference between heading angles of the recovery device and the vehicle, the velocity, the angular velocity, and a rudder angle of a steering rudder of the vehicle are used as an input state vector of a servo docking controller, according to the relative position and a difference in the heading angles, three docking states are classified, for the different docking states, reinforcement learning cost functions are designed respectively to train a deep network-based servo docking controller, thereby implementing horizontal plane docking control of the vehicle;

the input state vector of the depth tracking controller is specifically as follows:

$$\{e_z, \theta, u, v, w, p, q, r\}$$

wherein $e_z$ represents the depth error between the vehicle and the recovery device, θ denotes the pitch angle of the vehicle, u signifies a forward linear velocity of the vehicle, v indicates a lateral linear velocity of the vehicle, w represents a vertical linear velocity of the vehicle, p denotes a roll angular velocity of the vehicle, q signifies a pitch angular velocity of the vehicle, and r represents a heading yaw angular velocity of the vehicle;

the reinforcement learning cost function of the depth tracking controller is as follows:

$$rws = -k_z|e_z| - k_\theta|\theta| - k_p|p|$$

wherein rws represents a total cost value of deep reinforcement learning; $k_z$ denotes a depth error weight; $k_\theta$ signifies a pitch angle weight; and kp designates a roll angular velocity weight;

the reinforcement learning cost function for the servo docking controller is as follows:

a reinforcement learning cost function in a state of adjusting the heading angle to the right is as follows:

$$rws = -k_\chi p_\chi(\chi) - k_\vartheta p_\vartheta(\vartheta) - k_r|\Delta r| - k_{\delta_r}|\delta_r - \delta_r^{max}|$$

wherein rws represents a total cost value of reinforcement learning for docking, $k_\chi$ denotes a docking path deviation weight, while kg signifies a bearing angle deviation weight, $p_\chi(\chi)$ is a tuning function for a docking path deviation, $p_\vartheta(\vartheta)$ is a tuning function for a bearing angle deviation, $k_r$ denotes a difference weight in heading angle, $k_{\delta_r}$ represents a rudder angle weight, $\delta_r^{max}$ indicates an amplitude of the steering rudder angle for the vehicle, ϑ represents a positional angle, Δr denotes a difference in the heading yaw angular velocity of the vehicle within a control time interval, and $\delta_r$ represents the rudder angle of the steering rudder of the vehicle;

a reinforcement learning cost function in a state of adjusting the heading angle to the left is as follows:

$$rws = -k_\chi p_\chi(\chi) - k_\vartheta p_\vartheta(\vartheta) - k_r|\Delta r| - k_{\delta_r}|\delta_r - \delta_r^{max}|$$

a reinforcement learning cost function in an error adjustment state is as follows:

$$rws=-k_{\chi}p_{\chi}(\chi)-k_{\vartheta}p_{\vartheta}(\vartheta)-k_r|\Delta r|.$$

2. The method according to claim 1, wherein the input state vector of the servo docking controller is specifically as follows:

$$\{x,y,e_{\psi},u,v,w,p,q,\Delta r,\delta_r\}$$

wherein x and y respectively represent a forward coordinate and a lateral coordinate of the recovery device relative to the vehicle, $e_{\psi}$ denotes the difference between the heading angle of the recovery device and the heading angle of the vehicle, u signifies the forward linear velocity of the vehicle, v indicates the lateral linear velocity of the vehicle, w denotes the vertical linear velocity of the vehicle, p represents the roll angular velocity of the vehicle, q signifies the pitch angular velocity of the vehicle, Δr denotes the difference in the heading yaw angular velocity of the vehicle within the control time interval, and $\delta_r$ represents the rudder angle of the steering rudder of the vehicle.

3. The method according to claim 2, wherein the three docking states are classified according to the relative position and the difference in the heading angles, specifically:

if a following condition is met: $e_{\psi}<0$, $\vartheta>0$, $|e_{\psi}|<|\vartheta|$, then the docking state is adjusting the heading angle to the right;

if a following condition is met: $e_{\psi}>0$, $\vartheta<0$, $|e_{\psi}|<|\vartheta|$, then the docking state is adjusting the heading angle to the left;

otherwise, the docking state is error adjustment;

wherein $\vartheta$ represents the positional angle, $$\vartheta = \arctan\frac{y}{x}.$$

4. The method according to claim 1, wherein the tuning function $p_{\chi}(\chi)$ for the docking path deviation is as follows:

$$p_{\chi}(\chi) = \frac{e^{\frac{|\chi|}{\chi^{max}-e}} - \frac{|\chi|}{\chi^{max}}}{2}\chi_{max}$$

wherein $\chi$ represents the docking path deviation, $\chi=R\sin(e_{\psi}+\vartheta)$, $R=\sqrt{x^2+y^2}$, $\chi_{max}$ denotes half of a sonar field of view width; $e_{\psi}$ denotes a difference between the heading angle of the recovery device and the heading angle of the vehicle, x and y respectively represent a forward coordinate and a lateral coordinate of the recovery device relative to the vehicle, and R is a relative distance;

the tuning function $p_{\vartheta}(\vartheta)$ for the bearing angle deviation is as follows:

$$p_{\vartheta}(\vartheta)=e^{\varepsilon|\vartheta|}$$

wherein ε represents a constant exponential coefficient.

5. A docking control device for an underwater vehicle based on imaging sonar, comprising:

a depth tracking unit, for using a depth error between the vehicle and a recovery device, a pitch angle, a velocity, and an angular velocity of the vehicle as an input state vector of a depth tracking controller, designing a reinforcement learning cost function to train a deep network-based depth tracking controller, thereby implementing depth tracking control of the vehicle;

a horizontal docking unit, for using a relative position of the recovery device, a difference between heading angles of the recovery device and the vehicle, a velocity, an angular velocity, and a rudder angle of a steering rudder of the vehicle as an input state vector of a servo docking controller, classifying three docking states according to the relative position and the difference in the heading angles, and designing reinforcement learning cost functions respectively to train a deep network-based servo docking controller for the different docking states, thereby implementing horizontal plane docking control of the vehicle;

the input state vector of the depth tracking controller is specifically as follows:

$$\{e_z,\theta,u,v,w,p,q,r\}$$

wherein $e_z$ represents the depth error between the vehicle and the recovery device, θ denotes the pitch angle of the vehicle, u signifies a forward linear velocity of the vehicle, v indicates a lateral linear velocity of the vehicle, w represents a vertical linear velocity of the vehicle, p denotes a roll angular velocity of the vehicle, q signifies a pitch angular velocity of the vehicle, and r represents a heading yaw angular velocity of the vehicle;

the reinforcement learning cost function of the depth tracking controller is as follows:

$$rws=-k_z|e_z|-k_{\theta}|\theta|-k_p|p|$$

wherein rws represents a total cost value of deep reinforcement learning; $k_z$ denotes a depth error weight; $k_{\theta}$ signifies a pitch angle weight; and kp designates a roll angular velocity weight;

the reinforcement learning cost function for the servo docking controller is as follows:

a reinforcement learning cost function in a state of adjusting the heading angle to the right is as follows:

$$rws=-k_{\chi}p_{\chi}(\chi)-k_{\vartheta}p_{\vartheta}(\vartheta)-k_r|\Delta r|-k_{\delta_r}|\delta_r-\delta_r^{max}|$$

wherein rws represents a total cost value of reinforcement learning for docking, $k_{\chi}$ denotes a docking path deviation weight, while $k_{\vartheta}$ signifies a bearing angle deviation weight, $p_{\chi}(\chi)$ is a tuning function for a docking path deviation, $p_{\vartheta}(\vartheta)$ is a tuning function for a bearing angle deviation, $k_r$ denotes a difference weight in heading angle, $k_{\delta_r}$ represents a rudder angle weight, $\delta_r^{max}$ indicates an amplitude of the steering rudder angle for the vehicle, $\vartheta$ represents a positional angle, Δr denotes a difference in the heading yaw angular velocity of the vehicle within a control time interval, and $\delta_r$ represents the rudder angle of the steering rudder of the vehicle;

a reinforcement learning cost function in a state of adjusting the heading angle to the left is as follows:

$$rws=-k_{\chi}p_{\chi}(\chi)-k_{\vartheta}p_{\vartheta}(\vartheta)-k_r|\Delta r|-k_{\delta_r}|\delta_r-\delta_r^{max}|$$

a reinforcement learning cost function in an error adjustment state is as follows:

$$rws=-k_{\chi}p_{\chi}(\chi)-k_{\vartheta}p_{\vartheta}(\vartheta)-k_r|\Delta r|.$$

6. An electronic device, comprising:

a memory, for storing computer programs;

a processor, for executing the computer programs stored in the memory, when the computer programs stored in the memory are executed, the processor is used to perform the method according to claim 1.

7. A computer-readable storage medium, wherein the computer-readable storage medium stores a computer program, wherein when the computer program is run on a processor, the processor is enabled to execute the method according to claim 1.

* * * * *